US010410530B1

(12) United States Patent
Kant et al.

(10) Patent No.: US 10,410,530 B1
(45) Date of Patent: Sep. 10, 2019

(54) SYSTEMS AND METHODS FOR DETECTING POTENTIAL SURFACE COLLISIONS AND PROVIDING WARNINGS ONBOARD AN AIRCRAFT OR AIRPORT VEHICLE

(71) Applicant: HONEYWELL INTERNATIONAL INC., Morris Plains, NJ (US)

(72) Inventors: Laxmi Kant, Karnataka (IN); Mohan Gowda Chandrashekarappa, Karnataka (IN); Umasurya Sykam, Telangana (IN)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

(21) Appl. No.: 15/906,026

(22) Filed: Feb. 27, 2018

(51) Int. Cl.
*G08G 5/04* (2006.01)
*G08G 5/00* (2006.01)

(52) U.S. Cl.
CPC ..... *G08G 5/04* (2013.01); *G08G 5/0026* (2013.01)

(58) Field of Classification Search
None
See application file for complete search history.

(56) References Cited

U.S. PATENT DOCUMENTS 5,675,661 A 10/1997 Richman et al.
5,889,479 A 3/1999 Tabel
6,100,967 A 8/2000 De Cremiers
6,195,609 B1 * 2/2001 Pilley ..... G01C 23/00 701/120
8,024,078 B2 9/2011 Coulmeau et al.
(Continued)

FOREIGN PATENT DOCUMENTS

CN 101833104 B 9/2012
CN 106814370 A 6/2017
(Continued)

OTHER PUBLICATIONS

Pellegrini, P.F., et al.; Moving Object Detection and Tracking in Airport Surface Radar Images; 1994 Elsevier Science B.V.
(Continued)

*Primary Examiner* — Brian A Zimmerman
*Assistant Examiner* — Sara B Samson
(74) *Attorney, Agent, or Firm* — Lorenz & Kopf, LLP

(57) ABSTRACT

A method for providing surface collision warning data onboard a first airport vehicle comprising an aircraft or other airport vehicle configured for ground-based travel, by a processor communicatively coupled to a system memory element, is provided. The method aggregates, by the processor, three-dimensional (3D) spatial data associated with the first airport vehicle, an airport, and external airport vehicles located at the airport, to generate a set of aggregate data for the airport; determines a trajectory intent for each of the external airport vehicles; identifies potential surface collisions between the first airport vehicle and the external airport vehicles and between the first airport vehicle and the airport structures, based on the set of aggregate data for the airport, the trajectory intent for each of the external airport vehicles, and a trajectory associated with the first airport vehicle; and presents alerts associated with the potential surface collisions, via a display device communicatively coupled to the processor.

20 Claims, 12 Drawing Sheets

(56) References Cited

U.S. PATENT DOCUMENTS

| | | | | |
|---|---|---|---|---|
| 8,072,382 | B2 | 12/2011 | Smith et al. | |
| 9,384,586 | B1 | 7/2016 | McCusker et al. | |
| 9,656,607 | B2 | 5/2017 | Stein et al. | |
| 9,783,320 | B2 | 10/2017 | Barnes et al. | |
| 9,847,036 | B2 * | 12/2017 | Colmenares | G06T 7/75 |
| 2007/0067093 | A1 * | 3/2007 | Pepitone | G01C 23/005 701/120 |
| 2008/0062011 | A1 | 3/2008 | Butler et al. | |
| 2012/0072105 | A1 * | 3/2012 | Feyereisen | G01C 21/00 701/409 |
| 2013/0321194 | A1 * | 12/2013 | Kirk | B60Q 9/008 342/29 |
| 2014/0085124 | A1 | 3/2014 | Dusik et al. | |
| 2014/0303815 | A1 | 10/2014 | Lafon et al. | |
| 2015/0045994 | A1 * | 2/2015 | Krishna | B64C 25/44 701/3 |
| 2016/0171899 | A1 | 6/2016 | Depare et al. | |
| 2016/0196754 | A1 * | 7/2016 | Surace | G08G 5/0082 701/117 |
| 2016/0247406 | A1 | 8/2016 | Khatwa et al. | |
| 2017/0294132 | A1 | 10/2017 | Colmenares | |
| 2018/0096610 | A1 * | 4/2018 | Ray | G08G 5/04 |

FOREIGN PATENT DOCUMENTS

| | | | |
|---|---|---|---|
| EP | 1787142 | A1 | 5/2007 |
| WO | 2009075648 | A1 | 6/2009 |
| WO | 2016045703 | A1 | 3/2016 |
| WO | 2016162500 | A1 | 10/2016 |

OTHER PUBLICATIONS

Kumar, N.S., et al.; Integrated Enhanced and Synthetic Vision System for Transport Aircraft; Defence Science Journal, vol. 63, No. 2, Mar. 2013, pp. 157-163, DOI: 10.14429/dsj.63.4258 © 2013, DESIDOC.

USPTO Notice of Allowance for U.S. Appl. No. 15/907,528 dated Oct. 24, 2018.

* cited by examiner

SYSTEMS AND METHODS FOR DETECTING POTENTIAL SURFACE COLLISIONS AND PROVIDING WARNINGS ONBOARD AN AIRCRAFT OR AIRPORT VEHICLE

TECHNICAL FIELD

Embodiments of the subject matter described herein relate generally to aggregating aircraft data and airport data from disparate sources to identify and report potential collisions. More particularly, embodiments of the subject matter relate to identifying potential surface collisions based on trajectory conflicts in three-dimensional (3D) space.

BACKGROUND

According to a Flight Safety Foundation (FSF) report, each year, airliners and corporate jets across the world incur excessive costs attributed to apron damages. In an airport environment, a plurality of aircraft and airport vehicles are traveling to and from various airport locations, including airport docking stations, airport gates, airport terminals, aircraft taxiways and/or runways, and the like.

While traveling in an airport environment, it is critical for an aircraft to maintain adequate clearance from obstacles presented by the external aircraft, airport vehicles, and airport buildings and other structures, in order to avoid collisions. Many current collision-avoidance systems define threat warning functions based on the position of the intruder vehicles or objects and a constant surrounding boundary, but do not consider the relative shape and size of the intruders. Additionally, current collision-avoidance systems are often limited by a field of view of incorporated imaging sensors, and/or are ineffective for all operating environments. Airport traffic increasingly involves very large airliners with very long wingspans, which may reduce wingtip clearance margins between aircraft while in motion on airport ground surfaces, and which may make proper wingtip clearance relative to ground structures and other ground vehicular traffic more of a concern. Additionally, operations at an airport require a number of airport vehicles to operate in close proximity to airplanes. Aircraft service vehicles may require them to pass from under or over a parked or moving aircraft without posing collision dangers to the aircraft. The complex and dynamic airport environment requires all aircraft and vehicles operating at an airport to be safely separated from each other and from the airport structures.

Accordingly, it is desirable to provide additional information regarding potential conflicts or collisions onboard an aircraft. Furthermore, other desirable features and characteristics will become apparent from the subsequent detailed description and the appended claims, taken in conjunction with the accompanying drawings and the foregoing technical field and background.

BRIEF SUMMARY

Some embodiments of the present disclosure provide a method for providing surface collision warning data onboard a first airport vehicle comprising an aircraft or other airport vehicle configured for ground-based travel, by a processor communicatively coupled to a system memory element. The method aggregates, by the processor, three-dimensional (3D) spatial data associated with the first airport vehicle, an airport, and external airport vehicles located at the airport, to generate a set of aggregate data for the airport; determines a trajectory intent for each of the external airport vehicles; identifies potential surface collisions between the first airport vehicle and the external airport vehicles and between the first airport vehicle and the airport structures, based on the set of aggregate data for the airport, the trajectory intent for each of the external airport vehicles, and a trajectory associated with the first airport vehicle; and presents alerts associated with the potential surface collisions, via a display device communicatively coupled to the processor.

Some embodiments of the present disclosure provide a system for providing surface collision warning data onboard a first airport vehicle comprising an aircraft or other airport vehicle configured for ground-based travel. The system includes a system memory element; a display device, configured to present alerts onboard the first airport vehicle; and at least one processor, communicatively coupled to the system memory element and the display device, the at least one processor configured to: aggregate three-dimensional (3D) spatial data associated with the first airport vehicle, an airport, and external airport vehicles located at the airport, to generate a set of aggregate data for the airport; determine a trajectory intent for each of the external airport vehicles; identifying potential surface collisions between the first airport vehicle and the external airport vehicles and between the first airport vehicle and the airport structures, based on the set of aggregate data for the airport, the trajectory intent for each of the external airport vehicles, and a trajectory associated with the first airport vehicle; and presenting alerts associated with the potential surface collisions, via the display device.

Some embodiments of the present disclosure provide a non-transitory, computer-readable medium containing instructions thereon, which, when executed by a processor, perform a method for providing surface collision warning data onboard a first airport vehicle comprising an aircraft or other airport vehicle configured for ground-based travel. The method aggregates, by the processor, three-dimensional (3D) spatial data associated with the first airport vehicle, an airport, and external airport vehicles located at the airport, to generate a set of aggregate data for the airport, wherein the 3D spatial data comprises at least vehicle 3D model specification data, surface movement radar (SMR) image and pattern processing data, camera thermal imaging data, and an airport mapping database, wherein the airport mapping database comprises a 3D spatial mapping of the airport including surface markings and airport structures comprising at least gates, terminals, aprons, hangars, and docking stations; determines a trajectory intent for each of the external airport vehicles, wherein the external airport vehicles comprise at least a set of external aircraft, ground vehicles, stationary traffic, and moving traffic located at the airport; identifies potential surface collisions between the first airport vehicle and the external airport vehicles and between the first airport vehicle and the airport structures, based on the set of aggregate data for the airport, the trajectory intent for each of the external airport vehicles, and a trajectory associated with the first airport vehicle; and presents alerts associated with the potential surface collisions, via a display device communicatively coupled to the processor.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
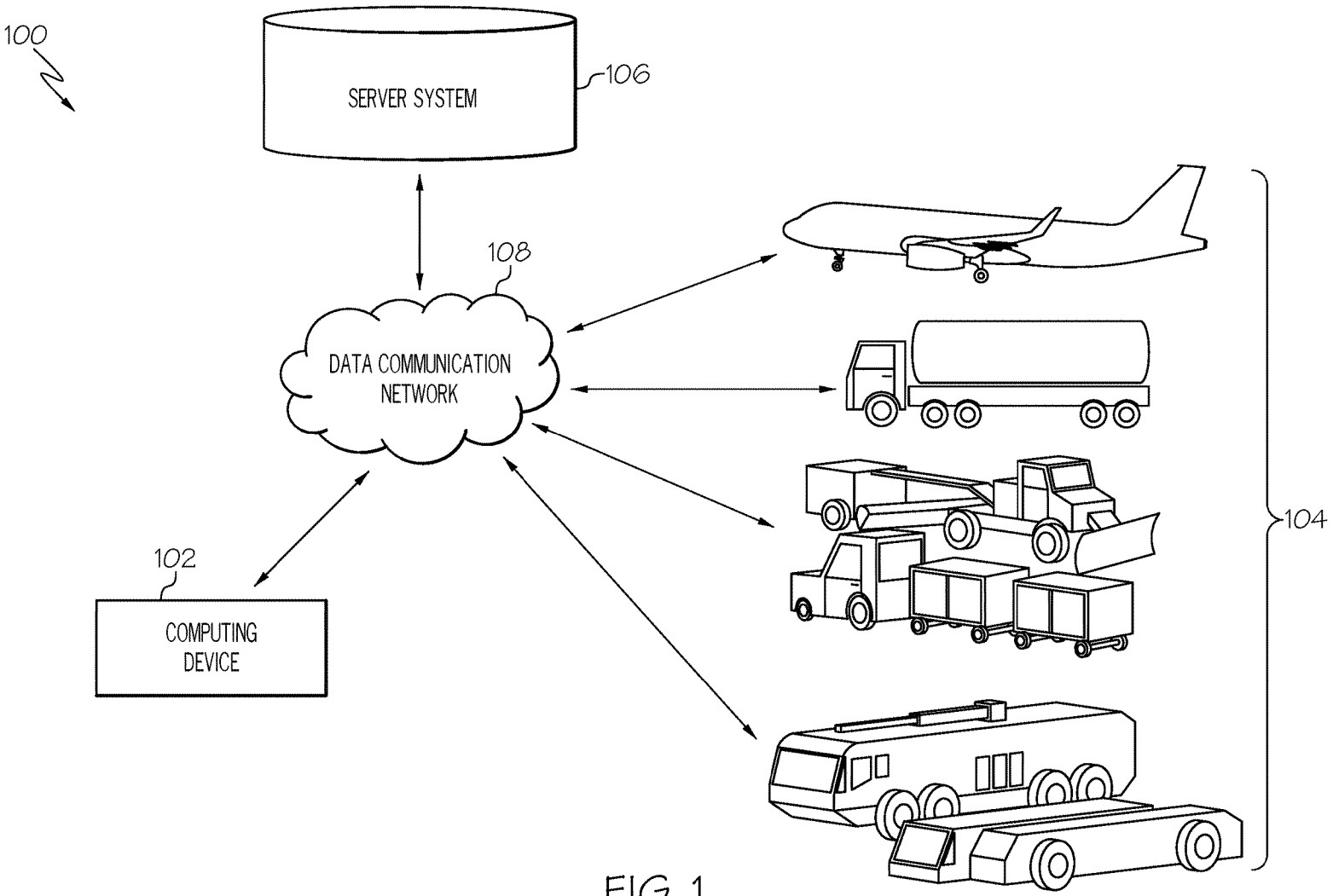
FIG. 1 is a diagram of a system for providing potential surface collision data onboard a first airport vehicle comprising an aircraft or other airport vehicle configured for ground-based travel, in accordance with the disclosed embodiments.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary or the following detailed description.

The subject matter presented herein relates to systems and methods for identifying and presenting potential collision data onboard an aircraft or airport vehicle traveling in an airport environment. More specifically, the subject matter relates to aggregating three-dimensional (3D) spatial data from a plurality of sources to create a set of aggregate, 3D spatial data applicable to the airport environment. Also contemplated herein is performing an analysis of the 3D spatial data to identify potential collisions between the aircraft or other airport vehicle and collision obstacles in the airport environment. Such collision obstacles may include, without limitation: other external airport vehicles, other external aircraft, and airport buildings and other structures. Collision obstacles may be static (i.e., not moving, parked/docked, stationary) or in motion. Alerts associated with the identified potential collisions may be presented, to provide additional situational awareness to the operator of the aircraft or other airport vehicle, during travel in the airport environment.

Certain terminologies are used with regard to the various embodiments of the present disclosure. An aircraft or airport vehicle may include any ground-based vehicle traveling in an airport environment. The airport environment includes surface markings and airport structures comprising at least gates, terminals, aprons, hangars, and docking stations. Contemplated herein is the identification of potential collisions associated with ground-based travel in the airport environment, based on analysis of (1) travel trajectories, and (2) three-dimensional (3D) spatial data for the aircraft or other airport vehicle and 3D spatial data for potential collision obstacles (e.g., external aircraft, external airport vehicles, airport buildings, and other airport structures). Three-dimensional (3D) spatial data describes the size, shape, dimensions, and location in the airport environment of the aircraft or other airport vehicle, any external aircraft, any external airport vehicle, and any building and/or fixed structure located in the airport environment. Each of the aircraft, the external aircraft, and the external airport vehicles may be traveling or remaining in a fixed position in the airport environment. The 3D spatial data includes 3D volumetric models of the aircraft, any external aircraft, the external airport vehicles, and any airport buildings and/or structures in the airport environment. The 3D volumetric models comprise a combination of multiple polygons in 3D space, and the external airport vehicles comprise at least a set of external aircraft, ground vehicles, stationary traffic, and moving traffic located at the airport. A trajectory is a path that an aircraft or airport vehicle travels, during ground-based travel through an airport environment, as a function of time. A potential surface collision is an identified circumstance wherein any portion of the 3D volumetric model of a first or "ownship" vehicle (e.g., an aircraft or other airport vehicle) is projected to overlap or be in the same location in 3D space as that of any portion of the 3D volumetric model of another vehicle, building or structure at the same time. One should appreciate that the surface collision detection and warning system of the invention operates in 3D space utilizing the 3D volumetric models of the objects by not limiting the implementation to a single designated position or a boxed circumference around the object location thereby providing more accuracy and allowing vehicles to operate in reduced proximity to each other.

Turning now to the figures, FIG. 1 is a diagram of a system for providing potential surface collision data onboard a first airport vehicle comprising an aircraft or other airport vehicle configured for ground-based travel, in accordance with the disclosed embodiments. The system 100 operates to (i) aggregate and analyze three-dimensional (3D) spatial data for an airport environment, to identify potential collision threats, and (ii) present potential collision alerts, such that one particular aircraft or other airport vehicle 104 may navigate ground travel throughout the airport environment and avoid collisions with other aircraft, external airport vehicles, and airport buildings and other structures. The system 100 may include, without limitation, a computing device 102 that is typically used onboard the aircraft or other airport vehicle 104, wherein the computing device 102 communicates with at least one server system 106, via a data communication network 108. In practice, certain embodiments of the system 100 may include additional or alternative elements and components, as desired for the particular application.

The computing device 102 may be implemented by any computing device that includes at least one processor, some form of memory hardware, a user interface, and communication hardware. For example, the computing device 102 may be implemented using a personal computing device, such as a tablet computer, a laptop computer, a personal digital assistant (PDA), a smartphone, or the like. In this scenario, the computing device 102 is capable of storing, maintaining, and executing an Electronic Flight Bag (EFB) application configured to aggregate and analyze 3D spatial data associated with an airport environment to identify potential collisions. In other embodiments, the computing device 102 may be implemented using a computer system or avionics system onboard the aircraft, or a computer system onboard another other airport vehicle 104, which is configured to aggregate and analyze 3D spatial data associated with an airport environment to identify potential collisions.

The aircraft or other airport vehicle 104 may be any aviation vehicle for which potential collision warnings and/or alerts are relevant and applicable during travel and static positioning (i.e., parking or docking) of aircraft or other airport vehicle 104 in an airport environment. In some embodiments, the aircraft or other airport vehicle 104 is implemented as an airplane, helicopter, spacecraft, hovercraft, or the like. In other embodiments, the aircraft or other airport vehicle 104 is implemented as a non-flying airport vehicle (e.g., baggage trucks, fuel trucks, repair vehicles, transport vehicles for airport ground support equipment) which is located in the airport environment. Like an airplane located in the airport environment, a non-flying airport vehicle also travels in the airport environment and may be positioned in a static manner (e.g., parking the airport vehicle).

The server system 106 may include any number of application servers, and each server may be implemented using any suitable computer. In some embodiments, the server system 106 includes one or more dedicated computers. In some embodiments, the server system 106 includes one or more computers carrying out other functionality in addition to server operations. The server system 106 may store and provide any type of data used to analyze potential collision threats in a particular airport environment. Such data may include, without limitation: 3D spatial data associated with a particular airport environment, which includes 3D volumetric models of the aircraft or other airport vehicle 104, any external airport vehicles, and external airport buildings or structures. Further, the server system 106 is configured to transfer an Airport Mapping Database (AMDB) on demand to a subscribing airport vehicle, and also to receive and aggregate data including 3D volumetric models of airport vehicles and airport structures into the Airport Mapping Database.

The computing device 102 is usually located onboard the aircraft or other airport vehicle 104, and the computing device 102 communicates with one or more remote servers (e.g., the server system 106) via wired and/or wireless communication connection. The computing device 102 and the server system 106 are generally disparately located, and the computing device 102 communicates with the server system 106 via the data communication network 108 and/or via communication mechanisms onboard the aircraft or other airport vehicle 104. In another architecture, the computing device may be located externally (i.e., in a remote location) to the aircraft or other airport vehicle 104, and only the computed surface collision threats and warnings are transmitted to the aircraft or other airport vehicle 104 via a communication channel (e.g., the data communication network 108).

The data communication network 108 may be any digital or other communications network capable of transmitting messages or data between devices, systems, or components. In certain embodiments, the data communication network 108 includes a packet switched network that facilitates packet-based data communication, addressing, and data routing. The packet switched network could be, for example, a wide area network, the Internet, or the like. In various embodiments, the data communication network 108 includes any number of public or private data connections, links or network connections supporting any number of communications protocols. The data communication network 108 may include the Internet, for example, or any other network based upon TCP/IP or other conventional protocols. In various embodiments, the data communication network 108 could also incorporate a wireless and/or wired telephone network, such as a cellular communications network for communicating with mobile phones, personal digital assistants, and/or the like. The data communication network 108 may also incorporate any sort of wireless or wired local and/or personal area networks, such as one or more IEEE 802.3, IEEE 802.16, and/or IEEE 802.11 networks, and/or networks that implement a short range (e.g., Bluetooth) protocol. The data communication network 108 may also include aircraft communications addressing and reporting system (ACARS) based or aircraft datalink based communication channels. For the sake of brevity, conventional techniques related to data transmission, signaling, network control, and other functional aspects of the systems (and the individual operating components of the systems) may not be described in detail herein.

During typical operation, the computing device 102 obtains 3D spatial data associated with a particular airport environment and the aircraft or other airport vehicle 104 from the remote server system 106. The computing device 102 then analyzes the relevant 3D spatial data and compares the 3D spatial data to trajectories associated with external aircraft and external airport vehicles to identify potential collision threats for the aircraft or other airport vehicle 104, while the aircraft or other airport vehicle 104 is located in the airport environment. Further, once the computing device 102 identifies potential collision threats, the computing device 102 presents alerts or notifications, such that operators of aircraft or other airport vehicle 104 can avoid predicted collisions.

Figure 2:
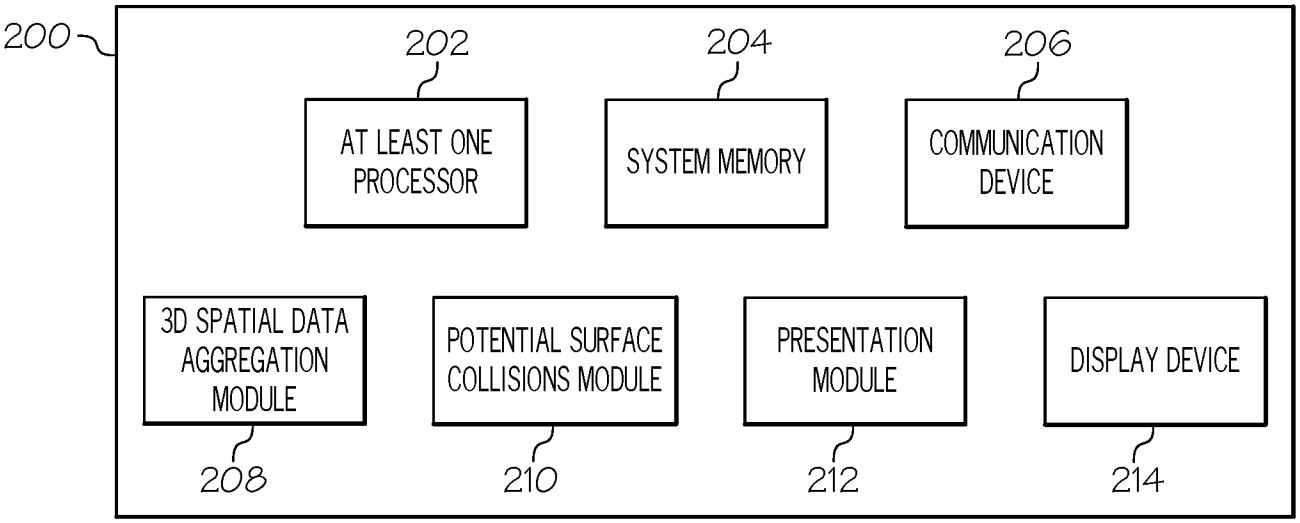
FIG. 2 is a functional block diagram of a computing device for use with a system for providing potential surface collision data, in accordance with the disclosed embodiments.
Figure 3A:
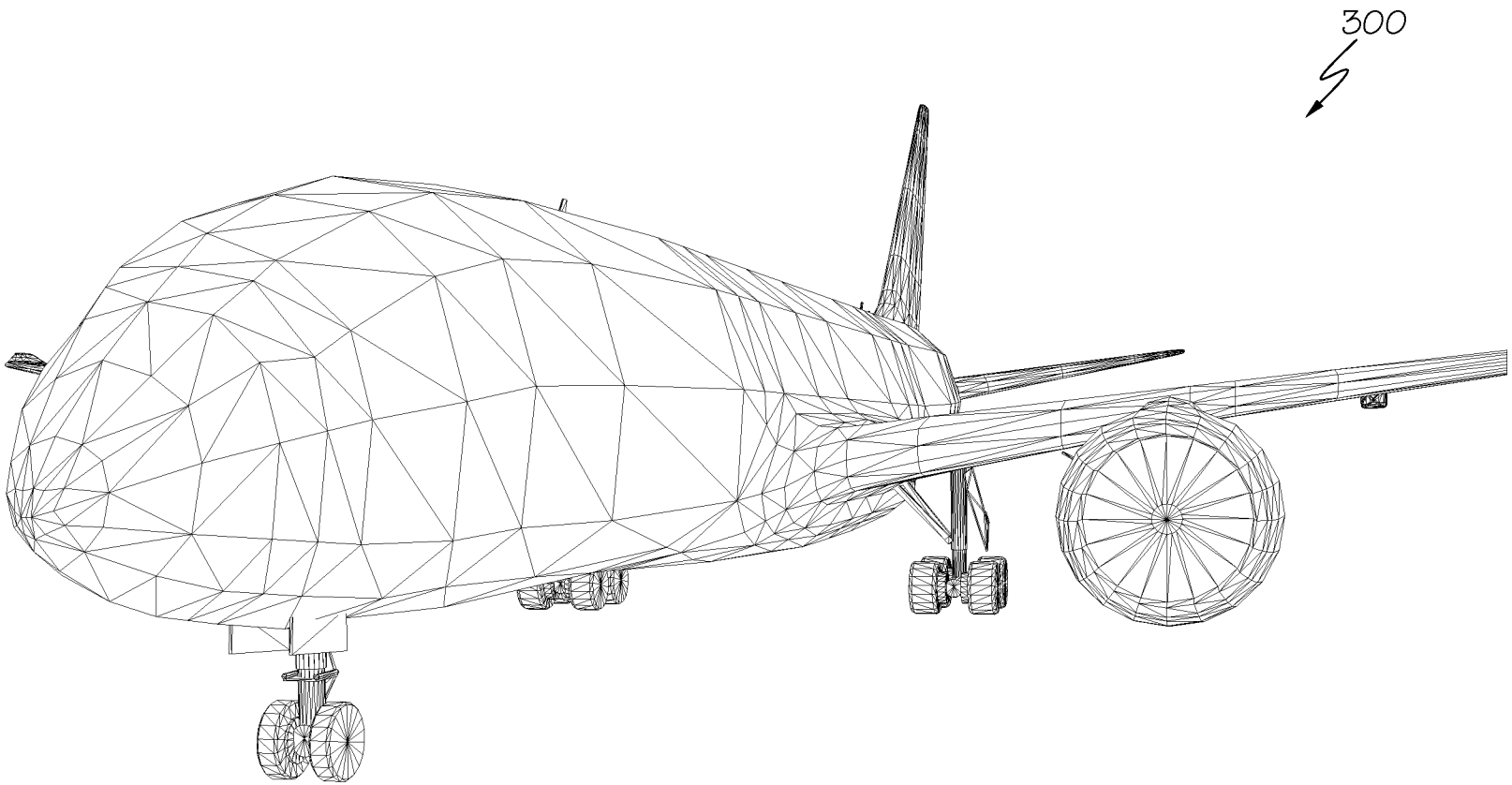
FIGS. 3A-3E are diagrams of three-dimensional (3D) spatial data used to identify potential surface collision data, in accordance with the disclosed embodiments.
Figure 3B:
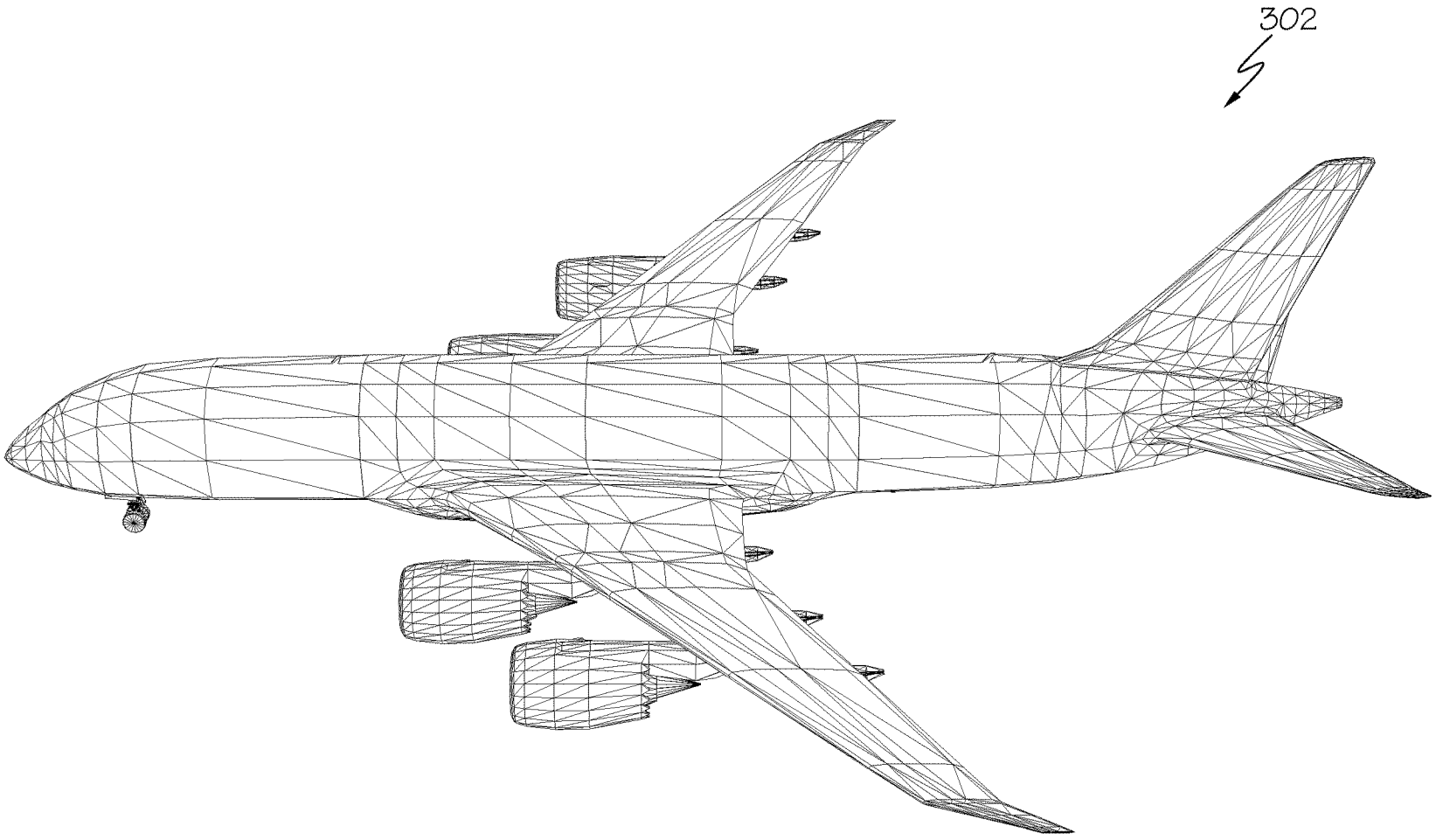
Figure 3C:
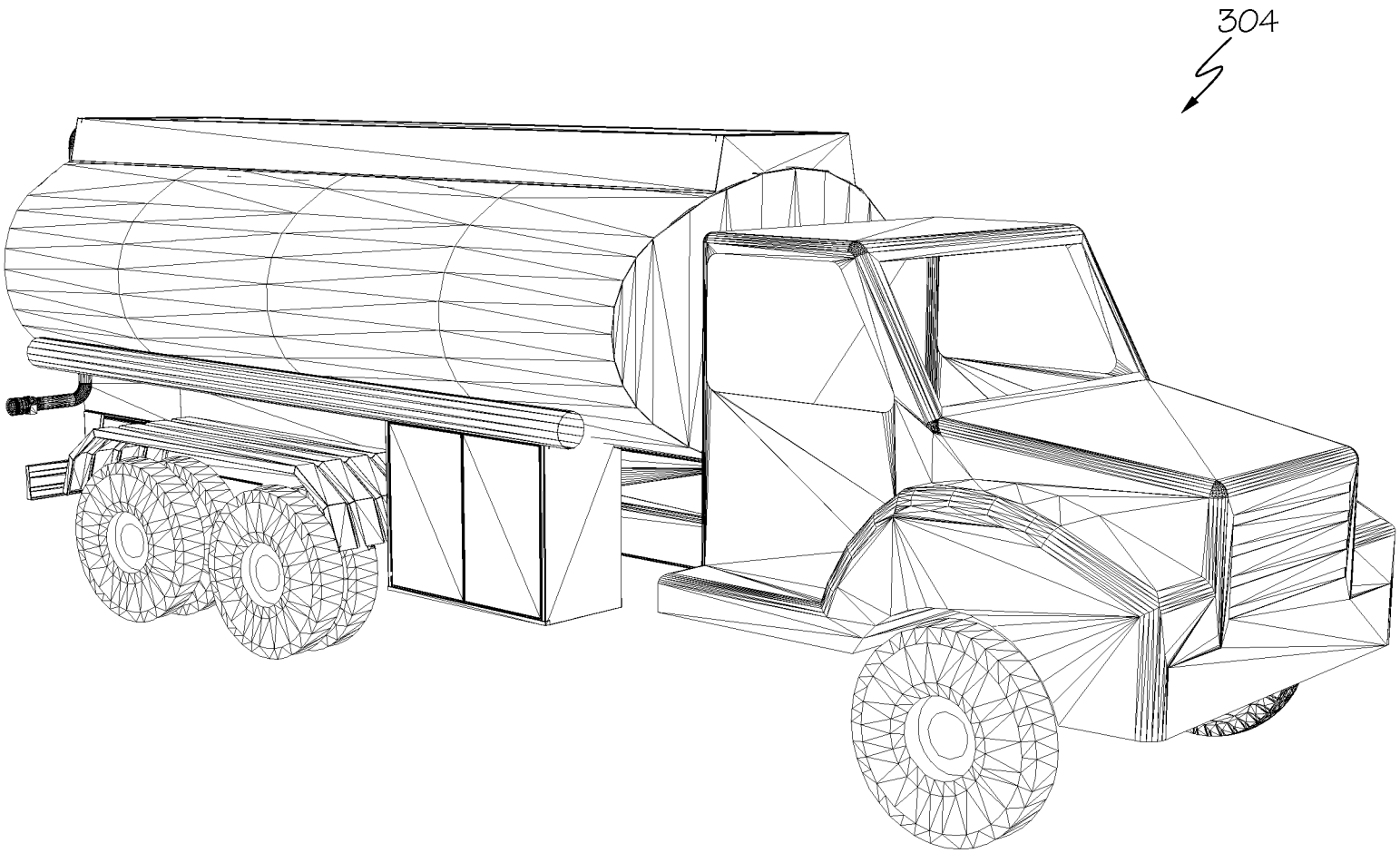
Figure 3D:
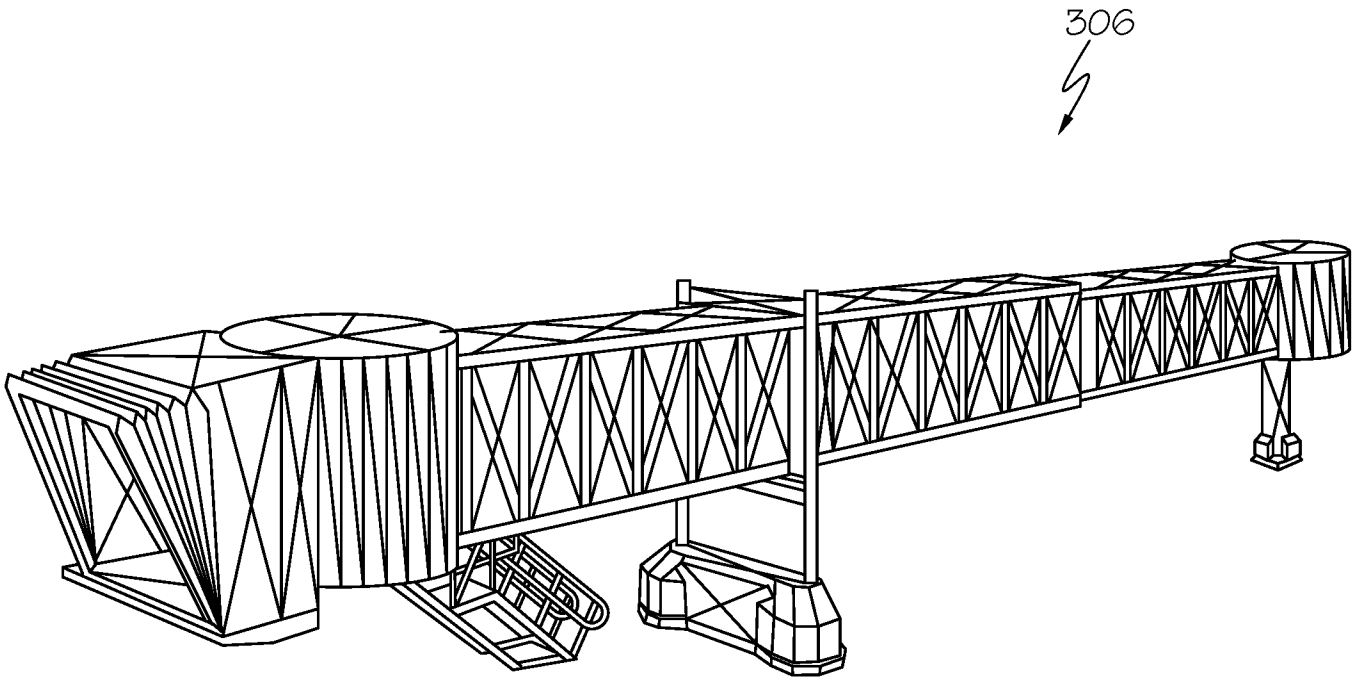
Figure 3E:
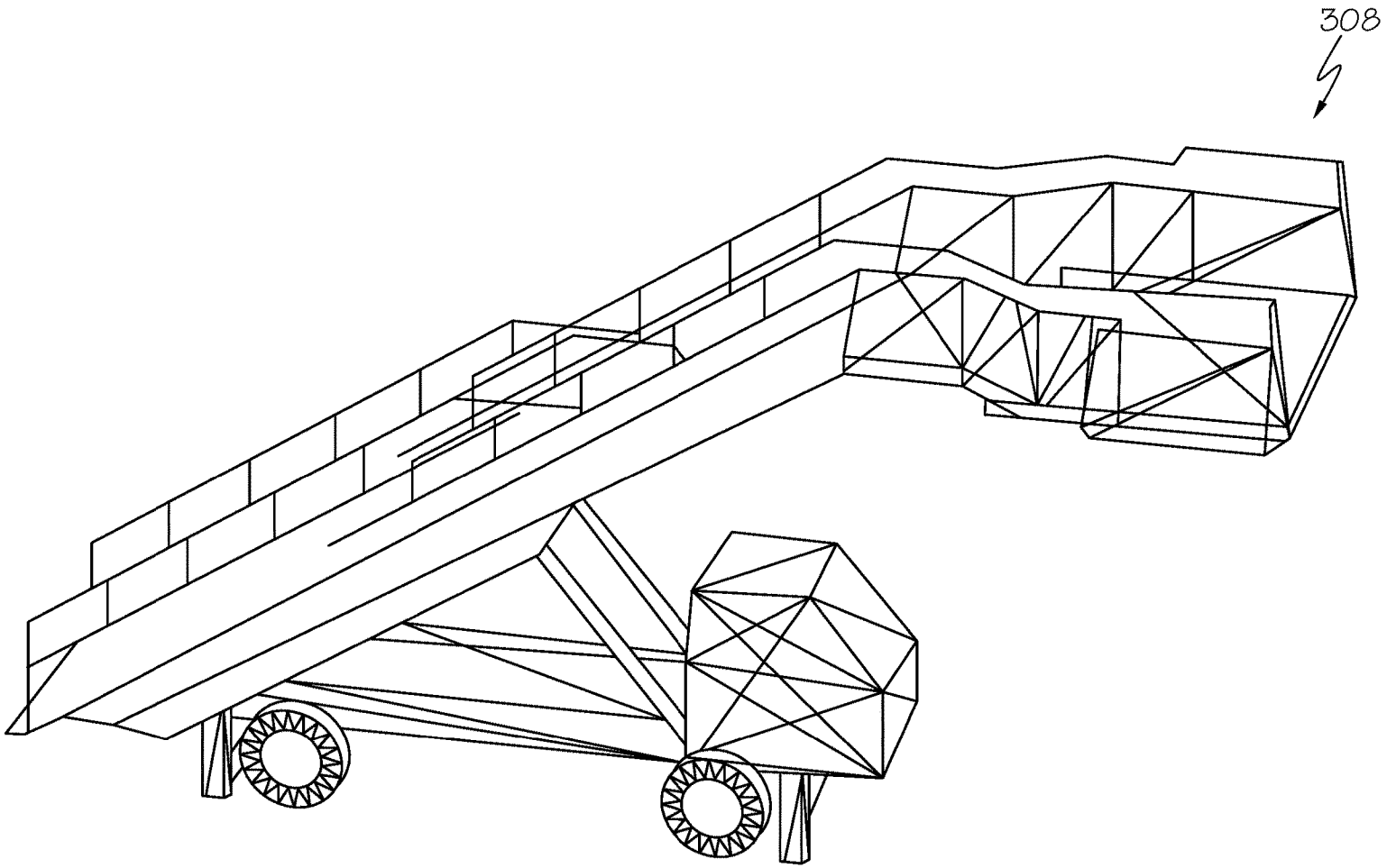

FIG. 2 is a functional block diagram of a computing device 200 for use with a system for providing potential surface collision data, in accordance with the disclosed embodiments. It should be noted that the computing device 200 can be implemented with the computing device 102 depicted in FIG. 1. In this regard, the computing device 200 shows certain elements and components of the computing device 102 in more detail.

The computing device 200 generally includes, without limitation: at least one processor 202; system memory 204; a communication device 206; a three-dimensional (3D) spatial data aggregation module 208; a trajectory module 210; a presentation module 212; and a display device 214. These elements and features of the computing device 200 may be operatively associated with one another, coupled to one another, or otherwise configured to cooperate with one another as needed to support the desired functionality—in particular, identifying potential collisions in an airport environment, as described herein. For ease of illustration and clarity, the various physical, electrical, and logical couplings and interconnections for these elements and features are not depicted in FIG. 2. Moreover, it should be appreciated that embodiments of the computing device 200 will include other elements, modules, and features that cooperate to support the desired functionality. For simplicity, FIG. 2 only depicts certain elements that relate to the potential collision threat identification techniques described in more detail below.

The at least one processor 202 may be implemented or performed with one or more general purpose processors, a content addressable memory, a digital signal processor, an application specific integrated circuit, a field programmable gate array, any suitable programmable logic device, discrete gate or transistor logic, discrete hardware components, or any combination designed to perform the functions described here. In particular, the at least one processor 202 may be realized as one or more microprocessors, controllers, microcontrollers, or state machines. Moreover, the at least one processor 202 may be implemented as a combination of computing devices, e.g., a combination of digital signal processors and microprocessors, a plurality of microprocessors, one or more microprocessors in conjunction with a digital signal processor core, or any other such configuration.

The at least one processor 202 is communicatively coupled to the system memory 204. The system memory 204 is configured to store any obtained or generated data associated with aggregated 3D spatial data and/or potential collision identification, and graphical elements associated with the aggregated 3D spatial data, the airport environment, and alerts or notifications associated with the identified potential collisions. The system memory 204 may be realized using any number of devices, components, or modules, as appropriate to the embodiment. Moreover, the computing device 200 could include system memory 204 integrated therein and/or a system memory 204 operatively coupled thereto, as appropriate to the particular embodiment. In practice, the system memory 204 could be realized as RAM memory, flash memory, EPROM memory, EEPROM memory, registers, a hard disk, a removable disk, or any other form of storage medium known in the art. In certain embodiments, the system memory 204 includes a hard disk, which may also be used to support functions of the computing device 200. The system memory 204 can be coupled to the at least one processor 202 such that the at least one processor 202 can read information from, and write information to, the system memory 204. In the alternative, the system memory 204 may be integral to the at least one processor 202. As an example, the at least one processor 202 and the system memory 204 may reside in a suitably designed application-specific integrated circuit (ASIC).

The communication device 206 is suitably configured to communicate data between the computing device 200 and one or more remote servers to obtain 3D spatial data associated with an airport environment. The communication device 206 may transmit and receive communications over a wireless local area network (WLAN), the Internet, a satellite uplink/downlink, a cellular network, a broadband network, a wide area network, or the like. As described in more detail below, data received by the communication device 206 may include, without limitation: 3D spatial data associated with the aircraft or airport vehicle located in the airport environment, and for which potential collisions are identified; and 3D spatial data for external aircraft, external airport vehicles, and airport buildings or structures. Data provided by the communication device 206 may include, without limitation, requests for 3D spatial data associated with particular types of aircraft and airport vehicles, and requests for 3D spatial data associated with particular airports (e.g., 3D Airport Mapping Database or AMDB in general), and the like.

The three-dimensional (3D) spatial data aggregation module 208 obtains (via the communication device 206) 3D spatial data associated with a particular aircraft or other airport vehicle traveling in a ground-based manner in an airport environment, and 3D spatial data for potential collision obstacles (e.g., external aircraft, external airport vehicles, airport buildings, and other airport structures) in the airport environment. To obtain the 3D spatial data, the 3D spatial data aggregation module 208 communicates with one or more remote servers that store vehicle manufacturer specifications and equipment specifications for the aircraft or airport vehicle that is performing ground-based traveling operations in the airport environment. The 3D spatial data aggregation module 208 also accesses the vehicle manufacturer specifications and equipment specifications for external aircraft and external vehicles in the airport environment, and airport mapping data for the airport itself. The vehicle manufacturer specifications and equipment specifications include 3D spatial data for the aircraft or other airport vehicle, external aircraft, and external airport vehicles located in the airport environment. The airport mapping data includes 3D spatial data for the airport buildings and other structures in the airport environment.

The 3D spatial data aggregation module 208 may be external or internal to the aircraft itself, and may use an aircraft mapping database which is loadable from an external source. Thus, the 3D spatial data aggregation module 208 builds the aggregated 3D mapping database offline and makes the aggregated 3D mapping database accessible to the computing device 200. The 3D spatial data aggregation module 208 optionally augments the aggregated 3D mapping database using obtained sensor data, wherein the augmented 3D mapping database may be used to derive and conceptualize the 3D spatial models of the aircraft vehicles (e.g., wherein the sensor data augments the equipment manufacturer specification data).

Exemplary embodiments of 3D spatial data (obtained by the 3D spatial data aggregation module 208) are shown in FIGS. 3A-3E. FIGS. 3A-3E are diagrams of three-dimensional (3D) spatial data used to identify potential surface collision data, in accordance with the disclosed embodiments. As shown, FIGS. 3A-3E include three-dimensional (3D) volumetric models of airport vehicles and ground support equipment, including: 3D volumetric models an aircraft 300, 302; a 3D volumetric model of a fuel truck 304; a 3D volumetric model of a boarding bridge 306; and a 3D volumetric model of a passenger staircase 308. It should be appreciated that FIGS. 3A-3E depict exemplary embodiments of aircraft, airport vehicles, and ground support equipment, and that 3D spatial data for various airports may include 3D volumetric models for additional vehicles and/or ground support equipment. Additionally, airport surface vehicles and aircraft may be of various types, shapes and sizes, and need not be limited to the exemplary embodiments shown.

Three-dimensional (3D) spatial data describes the size, shape, dimensions, and location in the airport environment of the aircraft or other airport vehicle, any external aircraft, any external airport vehicle, and any building and/or fixed structure located in the airport environment. Each of the aircraft, the external aircraft, and the external airport vehicles may be traveling or remaining in a fixed position in the airport environment. The 3D spatial data includes 3D volumetric models of the aircraft, any external aircraft, the external airport vehicles, and any airport buildings and/or structures in the airport environment. The 3D volumetric models comprise a combination of multiple polygons in 3D space, and the external airport vehicles comprise at least a set of external aircraft, ground vehicles, stationary traffic, and moving traffic located at the airport.

Returning to FIG. 2, in addition to obtaining the 3D spatial data from the vehicle manufacturer specifications, the equipment manufacturer specifications, and the airport mapping data, in certain embodiments the 3D spatial data aggregation module 208 communicates with various sensors on the aircraft or other airport vehicle to obtain sensor-based data to identify obstacles in the airport environment. For example, the 3D spatial data aggregation module 208 may obtain ground surveillance radar imagery, thermal imaging data, camera data, or video surveillance data from onboard the airport vehicle or aircraft, to identify collision threats in real-time. Thus, the 3D spatial data aggregation module 208 is configured to obtain a set of predefined and stored 3D spatial data (via remote servers or other data storage), and to obtain (via sensors) a set of dynamically updated 3D spatial data. The 3D spatial data aggregation module 208 is further configured to aggregate the sets of 3D spatial data to create an aggregate set of data that includes an airport moving map (AMM) database comprising the 3D volumetric models and a 3D spatial mapping of the airport.

The trajectory module 210 is configured to identify potential trajectories for a plurality of moving and stationary vehicles in an airport environment, including the aircraft or airport vehicle itself. In a connected airport environment, the predicted trajectories of all vehicles operating at the airport may be shared via a System Wide Information Network (SWIM), an Aeronautical Mobile Airport Communication System (AeroMACS) communication channel, or the like.

The potential surface collisions module 210 uses (i) locations of static buildings, structures, and parked/docked vehicles and aircraft, and (ii) three-dimensional (3D) spatial data that includes dimensions of aircraft, airport vehicles, and airport structures (obtained by the 3D spatial data aggregation module 208) to identify potential surface collisions, based on the determined trajectory of the ownship aircraft or airport vehicle; the determined trajectories and locations of static vehicles, aircraft, buildings, and other airport structures; and 3D volumetric data associated with the ownship aircraft or airport vehicle, external airport vehicles, and external airport structures. A potential surface collision is an instance wherein a trajectory associated with a first vehicle or "ownship" vehicle (e.g., an aircraft or other airport vehicle) intersects the trajectory of another vehicle or the location of a stationary building or structure in the airport environment and/or an object conflict in 3D space. In other words, using the first vehicle trajectory, the first vehicle is projected to move to a particular location (1) at a time when another vehicle is projected to be positioned at the particular location, or (2) wherein a stationary vehicle, building, or structure is positioned at the particular location. The potential surface collisions module 210 interprets trajectory conflicts and object conflicts in 3D space as potential collisions, since the first vehicle is projected to be in the same trajectory location and/or 3D spatial location as another vehicle, building, or structure at the same time. It should be appreciated that, though the position of an object is a single value of latitude and longitude, in the context of this disclosure, position overlap is when there exists an overlap of any part of the spatial 3D models of the aircraft, the airport vehicle, and the airport structure, even though the exact position values associated with the individual elements may not be the same or separated by a distance.

Figure 4A:
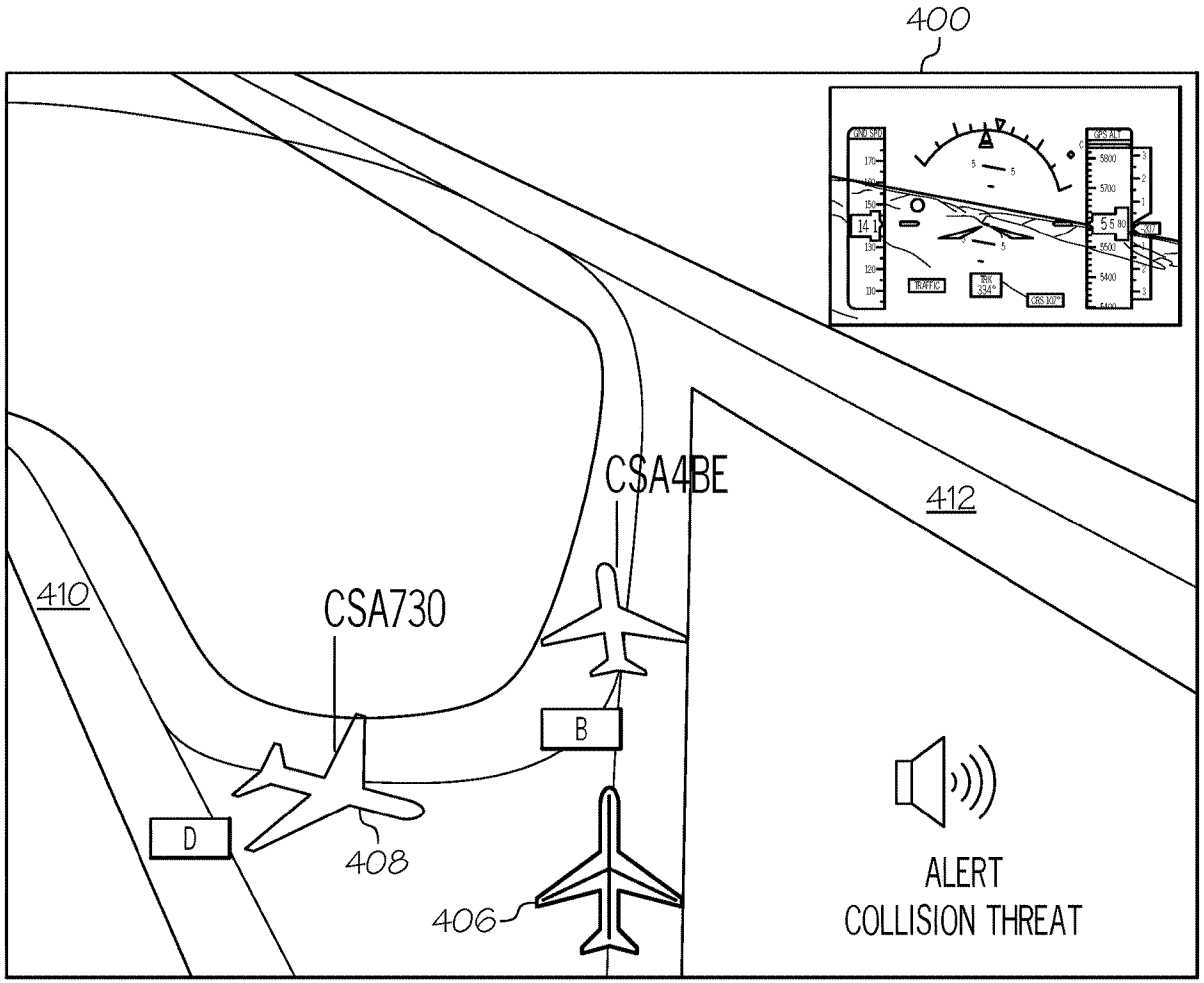
FIGS. 4A-4C are diagrams of presented alerts associated with potential surface collision data, in accordance with the disclosed embodiments.
Figure 4B:
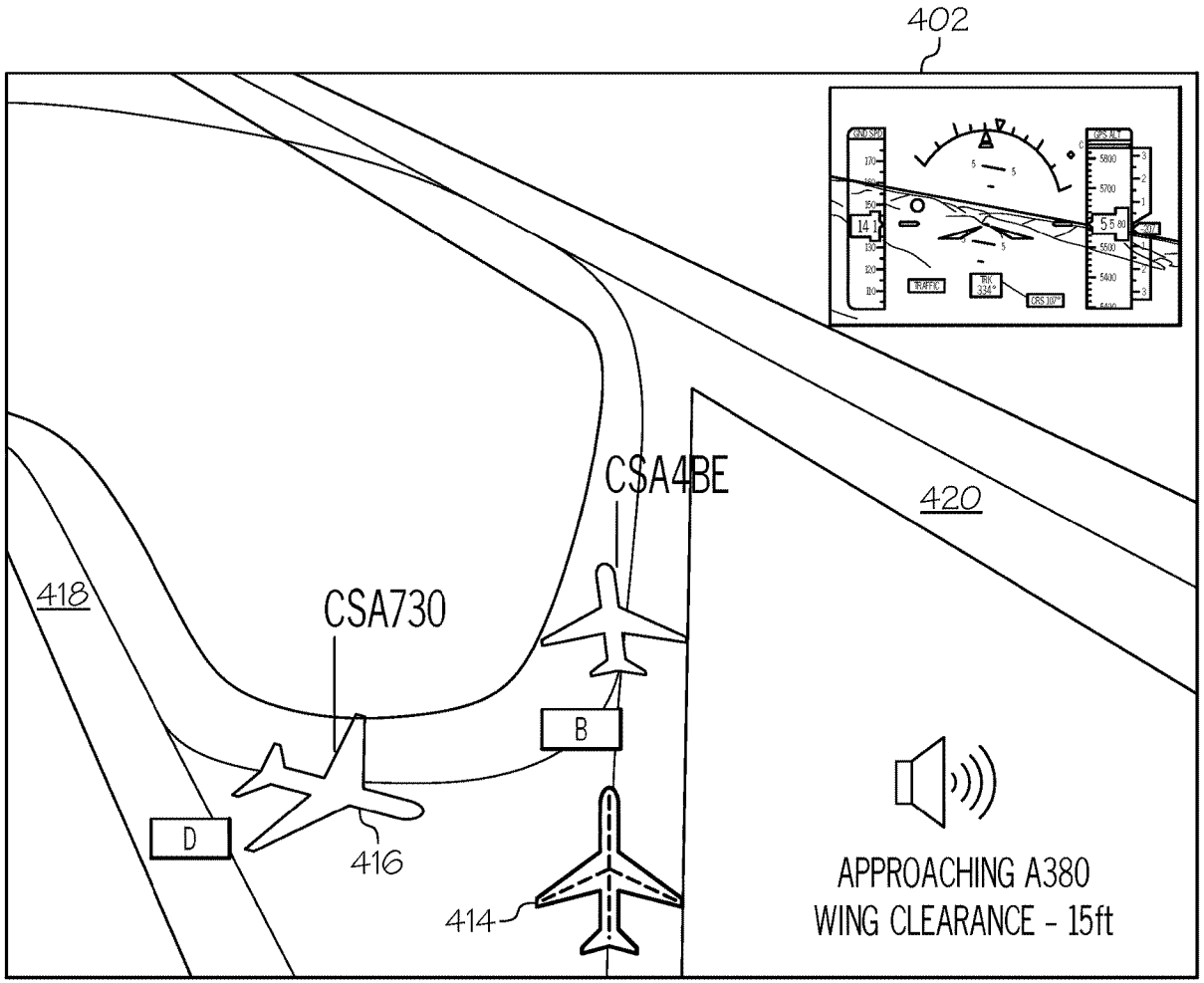
Figure 4C:
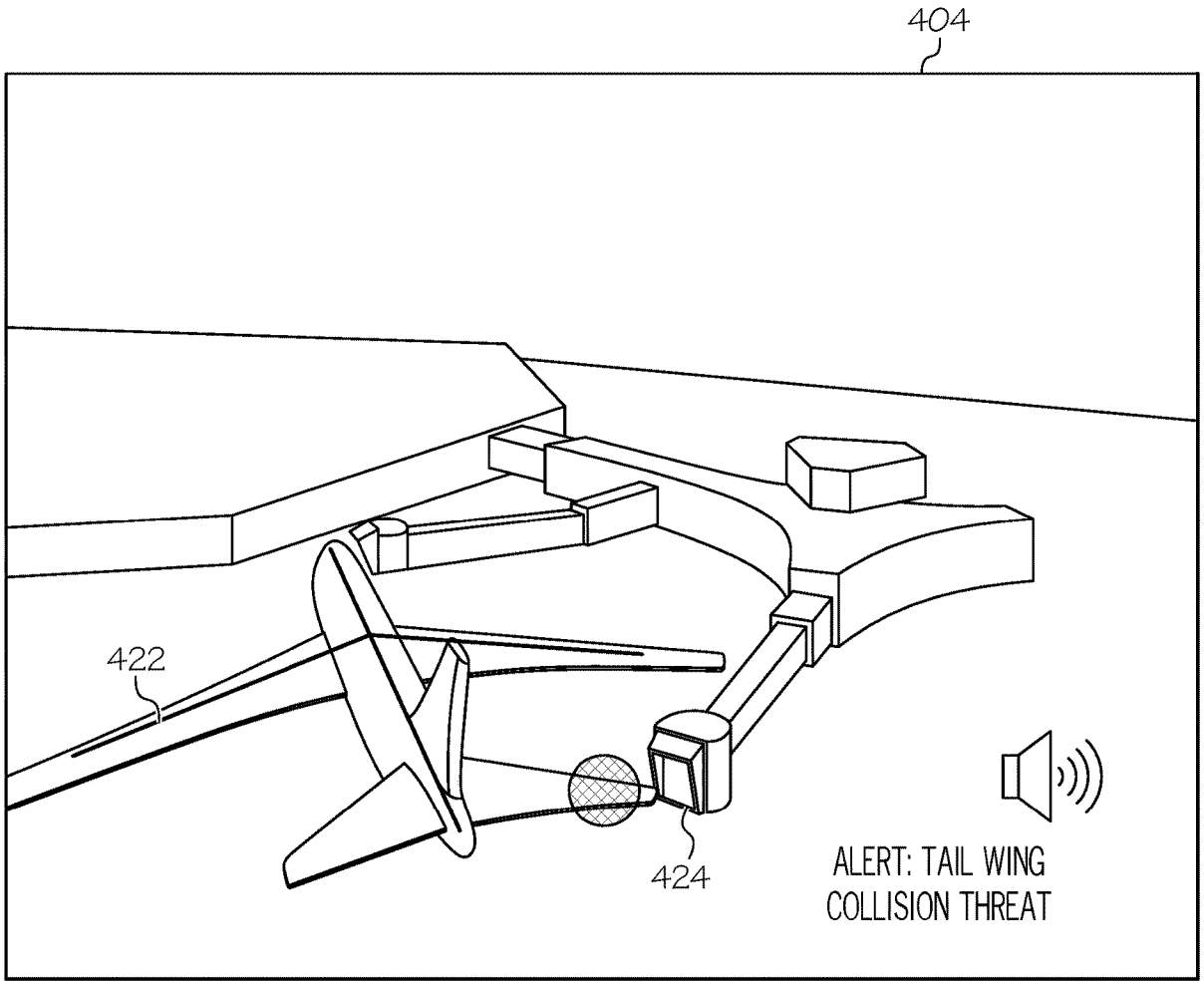

The presentation module 212 is configured to present graphical elements and text associated with 3D spatial data for an airport environment that includes the aircraft or airport vehicle itself, external aircrafts, external airport vehicles, and airport buildings and structures. In some embodiments, the presentation module 212 presents a graphical 3D model of the airport and the vehicles, aircraft, and structures/buildings located in the airport environment, wherein the graphical 3D model includes the 3D spatial data (e.g. 3D volumetric models comprising a combination of multiple polygons in 3D space). The presentation module 212 is further configured to present notifications and alerts associated with identified potential surface collisions (i.e., trajectory conflicts and/or object conflicts in 3D space), including but not limited to visual cues, auditory alerts, and/or text-based messages, as depicted in FIGS. 4A-4C. FIGS. 4A-4C are diagrams of presented alerts associated with potential surface collision data, in accordance with the disclosed embodiments.

FIG. 4A is a diagram of an exemplary embodiment of a graphical presentation 400 used to display a warning or notification of a surface collision threat. The graphical presentation 400 includes a first aircraft 406 (i.e., an "ownship" aircraft) traveling in an airport environment on a taxiway 410 near a runway 412, and a second aircraft 408 (i.e., an "external" aircraft) traveling on the taxiway 410 toward the first aircraft 406. Three-dimensional (3D) spatial data and trajectory data associated with the first aircraft 406 and the second aircraft 408 may be processed and analyzed to identify potential wingtip collisions between the first aircraft 406 and the second aircraft 408 on the predicted taxi guidance path. The graphical presentation 400 may be displayed by a personal computing device that executes an Electronic Flight Bag (EFB) application, or by an aircraft onboard avionics device that executes potential collision warning application. The EFB application and/or avionics application is configured to present the alert message using graphical elements and text, and in some embodiments, the EFB application and/or avionics application presents the first aircraft (i.e., the "ownship" aircraft) using visually distinguishable characteristics (e.g., highlighting, different colors).

FIG. 4B is a diagram of an exemplary embodiment of a graphical presentation 402 used to display a warning or notification of an approaching wing clearance issue. The graphical presentation 402 includes a first aircraft 414 (i.e., an "ownship" aircraft) traveling in an airport environment on a taxiway 418 near a runway 420, and a second aircraft 416 (i.e., an "external" aircraft) traveling on the taxiway 418 toward the first aircraft 414. In this example, the first aircraft 414 is an airplane model that includes wings positioned below the wings of the second aircraft 416. In this embodiment, the graphical presentation 402 displays two alerts: a first alert notifying the operator of the first aircraft 414 of the proximity of the oncoming second aircraft 416, and a second alert notifying the operator of the first aircraft 414 that the wings of the first aircraft 414 are cleared by a specified height (e.g., 15 feet) and therefore no collision is anticipated.

FIG. 4C is a diagram of an exemplary embodiment of a graphical presentation 404 used to display a warning or notification of a tail wing collision threat. The graphical presentation 404 includes a first aircraft 422 (i.e., an "ownship" aircraft) traveling in an airport environment near an airport gate. In this example, the 3D spatial data processing of the first aircraft 422 and the airport structures in the vicinity of the first aircraft 422 is used to identify incursion threats of external equipment, external vehicles, and/or airport structures in the airport environment. Here, a passenger bridge 424 is located in close proximity to a tail wing of the first aircraft 422, and a potential collision warning is displayed by the graphical presentation 404.

As shown, FIGS. 4A-4C present exemplary embodiments of notifications or warnings (via a display of the computing device). In practice, embodiments of the potential surface collision notifications or warnings may include additional or alternative graphical elements and text, as desired for the particular application.

Returning to FIG. 2, in practice, the 3D spatial data aggregation module 208, the trajectory module 210, and/or the presentation module 212 may be implemented with (or cooperate with) the at least one processor 202 to perform at least some of the functions and operations described in more detail herein. In this regard, the 3D spatial data aggregation module 208, the trajectory module 210, and/or the presentation module 212 may be realized as suitably written processing logic, application program code, or the like.

The display device 214 is configured to display various icons, text, and/or graphical elements associated with aggregated 3D spatial data associated with an aircraft or airport vehicle, external aircraft, external airport vehicles, and airport buildings and structures located in an airport environment. In an exemplary embodiment, the display device 214 is communicatively coupled to the at least one processor 202. The at least one processor 202, the presentation module 212, and the display device 214 are cooperatively configured to display, render, or otherwise convey one or more graphical representations or images associated with aggregated 3D spatial data and potential collision notifications and alerts on the display device 214, as described in greater detail below. In an exemplary embodiment, the display device 214 is realized as an electronic display configured to graphically display aggregated 3D spatial data, as described herein. In some embodiments, the computing device 200 is an integrated computer system onboard an aircraft, and the display device 214 is located within a cockpit of the aircraft, and is thus implemented as an aircraft display. In other embodiments, the display device 214 is implemented as a display screen of a standalone, personal computing device (e.g., laptop computer, tablet computer). It will be appreciated that although the display device 214 may be implemented using a single display, certain embodiments may use additional displays (i.e., a plurality of displays) to accomplish the functionality of the display device 214 described herein.

Figure 5:
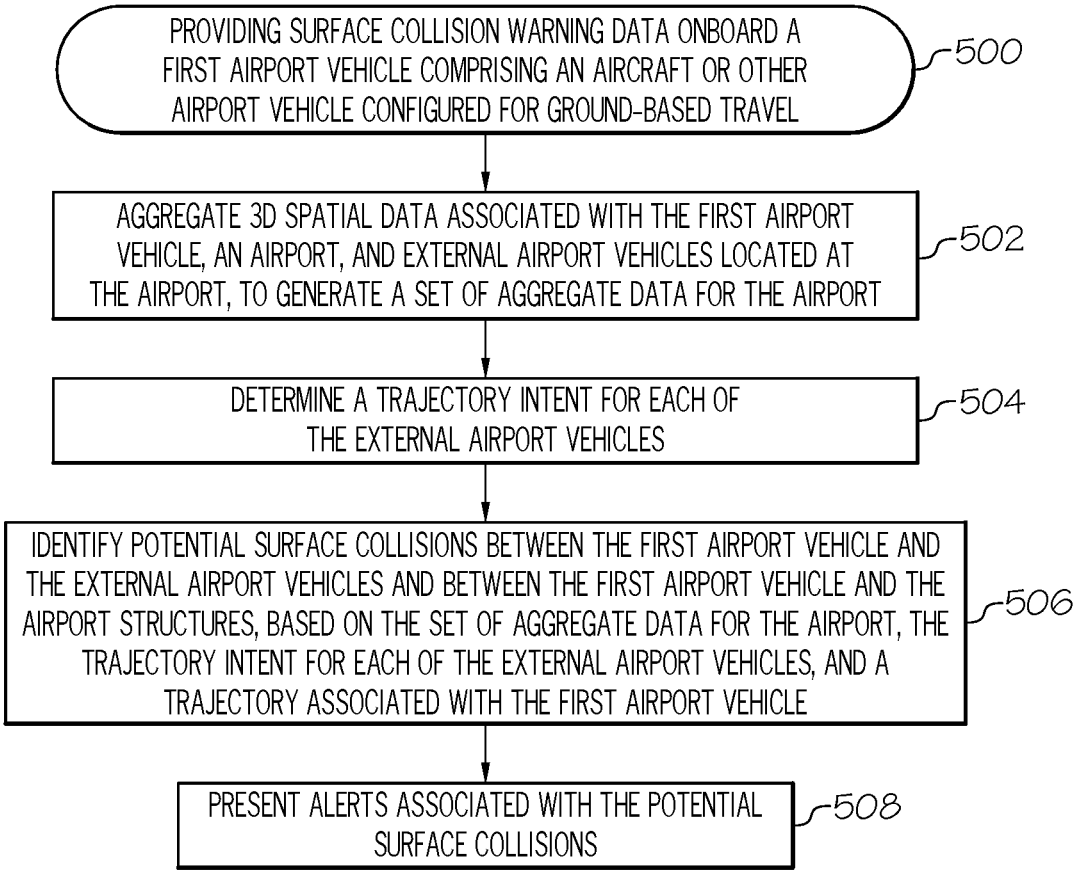
FIG. 5 is a flow chart that illustrates an embodiment of a process for providing surface collision warning data onboard a first airport vehicle comprising an aircraft or other airport vehicle configured for ground-based travel, in accordance with the disclosed embodiments.

FIG. 5 is a flow chart that illustrates an embodiment of a process 500 for providing surface collision warning data onboard an aircraft or airport vehicle, by a processor communicatively coupled to a system memory element, in accordance with the disclosed embodiments. The process 500 aggregates, by the processor, three-dimensional (3D) spatial data associated with the first airport vehicle, an airport, and external airport vehicles located at the airport, to generate a set of aggregate data for the airport (step 502). One suitable methodology for aggregating 3D spatial data is described below with reference to FIG. 6. The 3D spatial data is obtained from a variety of sources (see description of exemplary embodiments with regard to FIG. 6) and combined to create an aggregate set of data, which may be accessed and analyzed in real-time and/or stored for later use. The three-dimensional (3D) spatial data is associated with (i) a first airport vehicle comprising a particular aircraft or other airport vehicle traveling in a ground-based manner in an airport environment, and (ii) 3D spatial data for potential collision obstacles (e.g., external aircraft, external airport vehicles, airport buildings, and other airport structures) in the airport environment. Three-dimensional (3D) spatial data describes the size, shape, dimensions, and location in the airport environment of the aircraft or other airport vehicle, any external aircraft, any external airport vehicle, and any building and/or fixed structure located in the airport environment. Each of the aircraft, the external aircraft, and the external airport vehicles may be traveling or remaining in a fixed position in the airport environment.

The process 500 generally obtains the 3D spatial data from a remotely located server, as described previously with regard to FIG. 1. In some embodiments, the process 500 obtains the 3D spatial data and load the 3D spatial data into system memory of the computing device (e.g., the personal computing device or the integrated avionics system). Here, the process 500 establishes communication connections to one or more remote servers, via a communication device communicatively coupled to the processor; obtains the 3D spatial data associated with the aircraft, the airport, and the external airport vehicles, via the communication connections; and loads the 3D spatial data into the system memory element onboard the aircraft, wherein the method aggregates the 3D spatial data stored by the system memory element, and wherein the communication connections may include a wired or wireless network interface.

In other embodiments, the process 500 accesses the remotely located server dynamically, to obtain the 3D spatial data from the remotely located server in real-time and as needed onboard the aircraft. In this case, the process 500 establishes communication connections to one or more remote servers, via a communication device communicatively coupled to the processor; and accesses the 3D spatial data associated with the aircraft, the airport, and the external airport vehicles, via the communication connections, wherein the method aggregates the 3D spatial data stored by the one or more remote servers.

The process 500 may aggregate 3D spatial data using devices and/or hardware external or internal to the aircraft itself, and may use an aircraft mapping database which is loadable from an external source. Thus, the process 500 builds the aggregated 3D mapping database offline and makes the aggregated 3D mapping database accessible to the computing device (see FIGS. 1-2). The process 500 optionally augments the aggregated 3D mapping database using obtained sensor data, wherein the augmented 3D mapping database may be used to derive and conceptualize the 3D spatial models of the aircraft vehicles (e.g., wherein the sensor data augments the equipment manufacturer specification data).

The process 500 determines a trajectory intent for each of the external airport vehicles (step 504). Here, the process 500 identifies potential trajectories for a plurality of moving and stationary vehicles in an airport environment, including the first airport vehicle (e.g., aircraft or other airport vehicle configured for ground-based travel) itself. All aircrafts and airport vehicles operating at an airport are equipped with Automatic Dependent Surveillance-Broadcast (ADS-B) or related techniques to broadcast or otherwise transmit position information. Additionally, the System Wide Information Network (SWIM) infrastructure makes available, in real-time, the trajectory information and associated data for equipment (e.g., trucks and other airport vehicles) operating at an airport. Simplistically, the system of the proposed invention may use just the position and course information of airport vehicles and extrapolate a trajectory intent, or use the real-time trajectory information shared by aircraft and airport vehicles in addition to the position information to perform trajectory conflict detections and warn for surface collision threats.

The process 500 identifies potential surface collisions between the first airport vehicle and the external airport vehicles and between the first airport vehicle and the airport structures, based on the set of aggregate data for the airport, the trajectory intent for each of the external airport vehicles, and a trajectory associated with the aircraft (step 506). The process 500 uses locations of static buildings, structures, and parked/docked vehicles and aircraft to determine potential trajectory conflicts, based on the determined trajectories and locations of static vehicles, aircraft, buildings, and other airport structures.

Potential surface collisions may include trajectory conflicts and/or object conflicts in 3D space. A trajectory conflict is an instance wherein the trajectory associated with a first vehicle or "ownship" vehicle (e.g. an aircraft or other airport vehicle) comes in close proximity to the trajectory of another vehicle. An object conflict is an instance wherein the trajectory of the first vehicle (i.e., ownship vehicle) comes in close proximity to the location of a stationary building or structure in the airport environment such that the any part of the 3D volumetric representations of the participating objects overlap with each other. Two objects may be in conflict or collision course even though the two objects may be laterally separated by a distance (non-intersecting trajectories) but any portion of one of the two respective structures in 3D space contacts the other. For example, a small private jet can safely turn or pass underneath the wing of a large commercial aircraft without causing a collision, whereas a large aircraft executing the same maneuver near another large commercial aircraft may result in a surface collision threat.

Using the first vehicle trajectory, the first airport vehicle is projected to move to a particular location (1) at a time when another vehicle is projected to be positioned at the particular location, or (2) wherein a stationary vehicle, building, or structure is positioned at the particular location. The process 500 interprets trajectory conflicts and object conflicts as potential surface collisions, since the first vehicle is projected to be in the same location as another vehicle, building, or structure at the same time. For simplicity, though surface collisions occur when trajectories of multiple airport vehicles overlap, a trajectory overlap is imminent when any portion of the 3D volumetric models of the airport vehicles overlap, and not just when the line trajectories of the airport vehicles overlap.

The process 500 then presents alerts associated with the potential surface collisions, via a display device communicatively coupled to the processor (step 508). Exemplary embodiments of the alerts, and the presentation thereof, are described with regard to FIGS. 4A-4C. Alerts generally include at least one of a visual cue, an auditory alert, or a text-based message. In some embodiments, alerts may be presented using distinguishing visual characteristics, to capture the attention of the flight crew when the conditions for potential collisions are present, during aircraft travel in the airport environment.

The process 500 may be implemented as an Electronic Flight Bag (EFB) application that is stored, maintained, and executed by a personal computing device (e.g., a smartphone, a tablet computer, a laptop computer) and/or as an airport moving map (AMM) application that is stored, maintained, and executed by an aircraft onboard avionics device. In the first scenario, wherein the process 500 is implemented as an EFB application, the process 500 executes the EFB application, by the processor, wherein the processor is implemented as a personal computing device; and performs operations to identify the surface collision warning data, via the EFB application, wherein the operations comprise aggregating the 3D spatial data, determining the trajectory intent, identifying the trajectory conflicts, identifying the object conflicts in 3D space, and presenting the alerts.

In the second scenario, wherein the process 500 is implemented as an AMM application, the process 500 executes the AMM application, by the processor, wherein the processor is implemented as an aircraft onboard avionics device; and performs operations to identify the surface collision warning data, via the AMM application, wherein the operations comprise aggregating the 3D spatial data, determining the trajectory intent, identifying the potential surface collisions, and presenting the alerts. Thus, the process 500 may be used as part of an avionics system integrated into the aircraft, or as an application for a standalone computing device.

Figure 6:
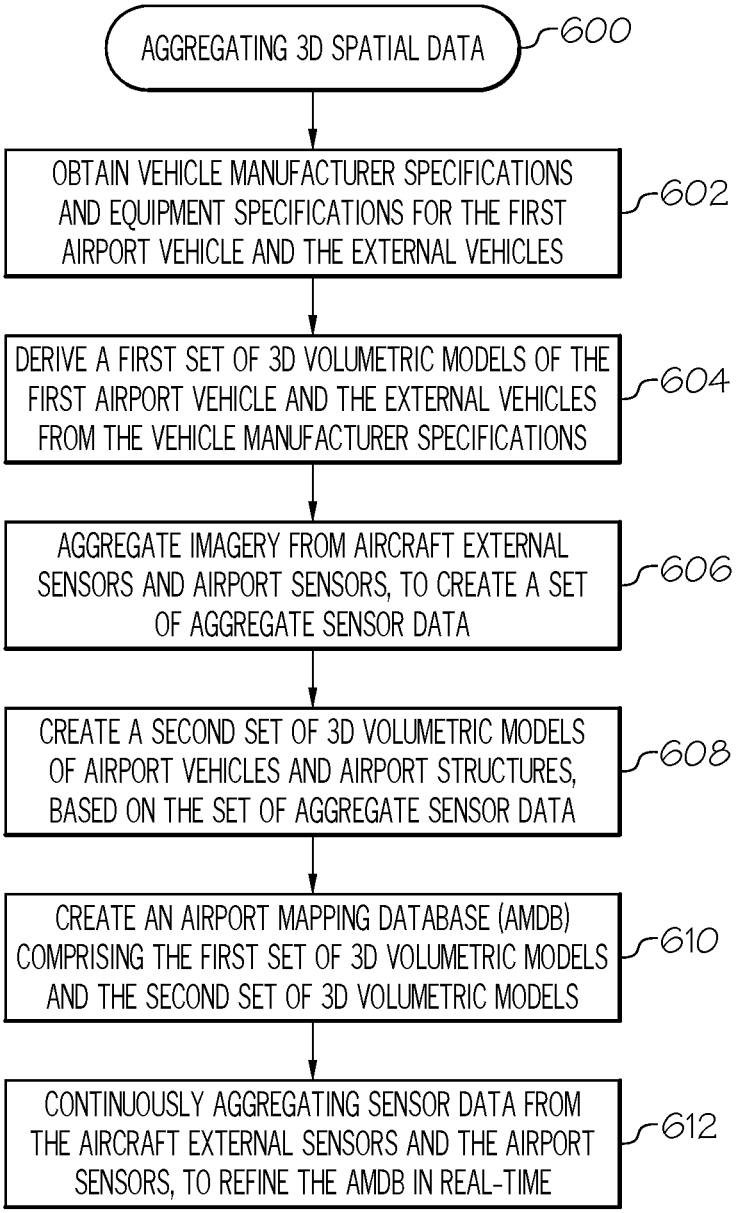
FIG. 6 is a flow chart that illustrates an embodiment of a process for aggregating spatial data, in accordance with the disclosed embodiments.

FIG. 6 is a flow chart that illustrates an embodiment of a process 600 for aggregating spatial data, in accordance with the disclosed embodiments. It should be appreciated that the process 600 described in FIG. 6 represents one embodiment of step 502 described above in the discussion of FIG. 5, including additional detail.

The process 600 obtains vehicle manufacturer specifications and equipment specifications for the first airport vehicle and the external vehicles (step 602). The process 600 may establish wired and/or wireless communication connections to a form of data storage (i.e., one or more servers or other type of memory hardware) to obtain stored vehicle manufacturer specifications applicable to the first airport vehicle and the external vehicles. The process 600 then derives a first set of 3D volumetric models of the first airport vehicle and the external vehicles from the vehicle manufacturer specifications (step 604). The vehicle manufacturer specifications include dimensions of the first airport vehicle and the external vehicles, which may include lengths and widths of each part of the aircraft, the overall size of the entire aircraft or vehicle, or the like. Here, the process 600 derives 3D volumetric model data from the obtained dimension data. The 3D volumetric models comprise a combination of multiple polygons in 3D space, and the external airport vehicles comprise at least a set of external aircraft, ground vehicles, stationary traffic, and moving traffic located at the airport. Alternatively, the process 600 may create the 3D volumetric models or representations from the Original Equipment Manufacturer (OEM) specifications of the aircraft, airport vehicles, and/or the airport structures. The 3D volumetric models may be simplistically represented as a combination of multiple polygons in 3D space.

The process 600 also aggregates imagery from aircraft external sensors and airport sensors, to create a set of aggregate sensor data (step 606). The aircraft external sensors may include, without limitation: cameras, RADAR, LIDAR, or any other type of sensor integrated into the aircraft and positioned such that sensor data is obtained from the exterior of the aircraft. The airport sensors may include, without limitation, surveillance cameras and/or surface RADAR positioned in and around the airport. The process 600 then creates a second set of 3D volumetric models of airport vehicles and airport structures, based on the set of aggregate sensor data (step 608). Thus, the process 600 creates a first set of 3D volumetric models of the first airport vehicle and the external vehicles (based on available manufacturer specifications) and a second set of 3D volumetric models of airport vehicles and airport structures (based on sensor imagery obtained in real-time).

The process 600 creates an airport mapping database (AMDB) comprising the first set of 3D volumetric models and the second set of 3D volumetric models (step 610). The 3D spatial mapping of the airport (i.e., 3D volumetric models of the airport and airport structures) includes surface markings and airport structures comprising at least gates, terminals, aprons, hangars, and docking stations. Here, the process 600 collects 3D spatial data that describes the size, shape, dimensions, and location in the airport environment of the first airport vehicle located in the airport environment, any external aircraft located in the airport environment, any external airport vehicle located in the airport environment, and any building and/or fixed structure located in the airport environment. Each of the first airport vehicle, the external aircraft, and the external airport vehicles may be traveling or remaining in a fixed position in the airport environment.

Additionally, in certain embodiments, the process 600 also obtains and continuously aggregates sensor data from the aircraft external sensors and the airport sensors, (e.g., during travel of the first airport vehicle in the airport) to refine the AMDB and identify collision threats in real-time (step 612). The sensor data may include, without limitation: ground surveillance radar imagery, thermal imaging data, camera data, and/or video surveillance data. The process 600 obtains the sensor data to identify, onboard the first airport vehicle, any external aircraft, external airport vehicles, and/or external buildings or structures that may present a potential collision threat for the first airport vehicle. The process 600 then updates and refines the AMDB using the updated sensor data.

The various tasks performed in connection with processes 500-600 may be performed by software, hardware, firmware, or any combination thereof. For illustrative purposes, the preceding descriptions of processes 500-600 may refer to elements mentioned above in connection with FIGS. 5-6. In practice, portions of processes 500-600 may be performed by different elements of the described system. It should be appreciated that processes 500-600 may include any number of additional or alternative tasks, the tasks shown in FIGS. 5-6 need not be performed in the illustrated order, and processes 500-600 may be incorporated into a more comprehensive procedure or process having additional functionality not described in detail herein. Moreover, one or more of the tasks shown in FIGS. 5-6 could be omitted from embodiments of the processes 500-600 as long as the intended overall functionality remains intact.

Techniques and technologies may be described herein in terms of functional and/or logical block components, and with reference to symbolic representations of operations, processing tasks, and functions that may be performed by various computing components or devices. Such operations, tasks, and functions are sometimes referred to as being computer-executed, computerized, software-implemented, or computer-implemented. In practice, one or more processor devices can carry out the described operations, tasks, and functions by manipulating electrical signals representing data bits at memory locations in the system memory, as well as other processing of signals. The memory locations where data bits are maintained are physical locations that have particular electrical, magnetic, optical, or organic properties corresponding to the data bits. It should be appreciated that the various block components shown in the figures may be realized by any number of hardware, software, and/or firmware components configured to perform the specified functions. For example, an embodiment of a system or a component may employ various integrated circuit components, e.g., memory elements, digital signal processing elements, logic elements, look-up tables, or the like, which may carry out a variety of functions under the control of one or more microprocessors or other control devices.

When implemented in software or firmware, various elements of the systems described herein are essentially the code segments or instructions that perform the various tasks. The program or code segments can be stored in a processor-readable medium or transmitted by a computer data signal embodied in a carrier wave over a transmission medium or communication path. The "computer-readable medium", "processor-readable medium", or "machine-readable medium" may include any medium that can store or transfer information. Examples of the processor-readable medium include an electronic circuit, a semiconductor memory device, a ROM, a flash memory, an erasable ROM (EROM), a floppy diskette, a CD-ROM, an optical disk, a hard disk, a fiber optic medium, a radio frequency (RF) link, or the like. The computer data signal may include any signal that can propagate over a transmission medium such as electronic network channels, optical fibers, air, electromagnetic paths, or RF links. The code segments may be downloaded via computer networks such as the Internet, an intranet, a LAN, or the like.

The following description refers to elements or nodes or features being "connected" or "coupled" together. As used herein, unless expressly stated otherwise, "coupled" means that one element/node/feature is directly or indirectly joined to (or directly or indirectly communicates with) another element/node/feature, and not necessarily mechanically. Likewise, unless expressly stated otherwise, "connected" means that one element/node/feature is directly joined to (or directly communicates with) another element/node/feature, and not necessarily mechanically. Thus, although the schematic shown in FIG. 2 depicts one exemplary arrangement of elements, additional intervening elements, devices, features, or components may be present in an embodiment of the depicted subject matter.

For the sake of brevity, conventional techniques related to signal processing, data transmission, signaling, network control, and other functional aspects of the systems (and the individual operating components of the systems) may not be described in detail herein. Furthermore, the connecting lines shown in the various figures contained herein are intended to represent exemplary functional relationships and/or physical couplings between the various elements. It should be noted that many alternative or additional functional relationships or physical connections may be present in an embodiment of the subject matter.

Some of the functional units described in this specification have been referred to as "modules" in order to more particularly emphasize their implementation independence. For example, functionality referred to herein as a module may be implemented wholly, or partially, as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices, or the like. Modules may also be implemented in software for execution by various types of processors. An identified module of executable code may, for instance, comprise one or more physical or logical modules of computer instructions that may, for instance, be organized as an object, procedure, or function. Nevertheless, the executables of an identified module need not be physically located together, but may comprise disparate instructions stored in different locations that, when joined logically together, comprise the module and achieve the stated purpose for the module. Indeed, a module of executable code may be a single instruction, or many instructions, and may even be distributed over several different code segments, among different programs, and across several memory devices. Similarly, operational data may be embodied in any suitable form and organized within any suitable type of data structure. The operational data may be collected as a single data set, or may be distributed over different locations including over different storage devices, and may exist, at least partially, merely as electronic signals on a system or network.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A method for providing surface collision warning data onboard a first airport vehicle comprising an aircraft or other airport vehicle configured for ground-based travel, by a processor communicatively coupled to a system memory element, the method comprising:

aggregating, by the processor, three-dimensional (3D) spatial data associated with the first airport vehicle, an airport, and external airport vehicles located at the airport, to generate a set of aggregate data for the airport;

determining a trajectory intent for each of the external airport vehicles;

identifying potential surface collisions between the first airport vehicle and the external airport vehicles and between the first airport vehicle and the airport structures, based on the set of aggregate data for the airport, the trajectory intent for each of the external airport vehicles, and a trajectory associated with the first airport vehicle; and presenting alerts associated with the potential surface collisions, via a display device communicatively coupled to the processor.

2. The method of claim 1, further comprising:

pre-loading a standard aircraft mapping database (AMDB) and an aggregated loadable aircraft mapping database into the system memory element, by the processor, wherein the aggregated loadable aircraft mapping database comprises the 3D spatial data associated with the first airport vehicle, an airport, and external airport vehicles located at the airport; and accessing the system memory element to obtain the 3D spatial data for aggregation.

3. The method of claim 1, further comprising:

establishing communication connections to one or more remote servers, via a communication device communicatively coupled to the processor; and accessing the 3D spatial data associated with the first airport vehicle, the airport, and the external airport vehicles, via the communication connections, wherein the method aggregates the 3D spatial data stored by the one or more remote servers.

4. The method of claim 1, wherein the alerts comprise at least one of a visual cue, an auditory alert, or a text-based message.

5. The method of claim 1, wherein aggregating the 3D spatial data further comprises:

obtaining vehicle manufacturer specifications and equipment specifications for the first airport vehicle and the external airport vehicles;

deriving a first set of 3D volumetric models of the first airport vehicle and the external airport vehicles from the vehicle manufacturer specifications;

aggregating imagery from aircraft external sensors and airport sensors, to create a set of aggregate sensor data;

creating a second set of 3D volumetric models of airport vehicles and airport structures, based on the set of aggregate sensor data; and creating an airport mapping database (AMDB) comprising the first set of 3D volumetric models and the second set of 3D volumetric models.

6. The method of claim 1, further comprising:

executing an Electronic Flight Bag (EFB) application, by the processor, wherein the processor is implemented as a personal computing device; and performing operations to identify the surface collision warning data, via the EFB application, wherein the operations comprise aggregating the 3D spatial data, determining the trajectory intent, identifying the trajectory conflicts, and presenting the alerts.

7. The method of claim 1, further comprising:

executing an airport moving map (AMM) application, by the processor, wherein the processor is implemented as an aircraft onboard avionics device; and performing operations to identify the surface collision warning data, via the AMM application, wherein the operations comprise aggregating the 3D spatial data, determining the trajectory intent, identifying the trajectory conflicts, and presenting the alerts.

8. A system for providing surface collision warning data onboard a first airport vehicle comprising an aircraft or other airport vehicle configured for ground-based travel, the system comprising:

a system memory element;

a display device, configured to present alerts onboard the first airport vehicle; and at least one processor, communicatively coupled to the system memory element and the display device, the at least one processor configured to:

aggregate three-dimensional (3D) spatial data associated with the first airport vehicle, an airport, and external airport vehicles located at the airport, to generate a set of aggregate data for the airport;

determine a trajectory intent for each of the external airport vehicles;

identifying potential surface collisions between the first airport vehicle and the external airport vehicles and between the first airport vehicle and the airport structures, based on the set of aggregate data for the airport, the trajectory intent for each of the external airport vehicles, and a trajectory associated with the first airport vehicle; and presenting alerts associated with the potential surface collisions, via the display device.

9. The system of claim 8, further comprising a communication device communicatively coupled to the at least one processor, the communication device configured to establish communication connections to one or more remote servers;

wherein the at least one processor is further configured to:

obtain the 3D spatial data associated with the first airport vehicle, the airport, and the external airport vehicles, via the communication device;

load the 3D spatial data into the system memory element onboard the first airport vehicle; and aggregate the 3D spatial data stored by the system memory element.

10. The system of claim 8, further comprising a communication device communicatively coupled to the at least one processor, the communication device configured to establish communication connections to one or more remote servers;

wherein the at least one processor is further configured to:

establish communication connections to one or more remote servers, via the communication device;

access the 3D spatial data associated with the first airport vehicle, the airport, and the external airport vehicles, via the communication device; and aggregate the 3D spatial data stored by the one or more remote servers.

11. The system of claim 8, wherein the alerts comprise at least one of a visual cue, an auditory alert, or a text-based message.

12. The system of claim 8, wherein the at least one processor is further configured to aggregate the 3D spatial data, by:

obtaining vehicle manufacturer specifications and equipment specifications for the first airport vehicle and the external airport vehicles;

deriving a first set of 3D volumetric models of the first airport vehicle and the external airport vehicles from the vehicle manufacturer specifications;

aggregating imagery from aircraft external sensors and airport sensors, to create a set of aggregate sensor data;

creating a second set of 3D volumetric models of airport vehicles and airport structures, based on the set of aggregate sensor data; and creating an airport mapping database (AMDB) comprising the first set of 3D volumetric models and the second set of 3D volumetric models.

13. The system of claim 8, wherein the at least one processor is further configured to:

execute an Electronic Flight Bag (EFB) application, wherein the processor is implemented as a personal computing device; and perform operations to identify the surface collision warning data, via the EFB application, wherein the operations comprise aggregating the 3D spatial data, determining the trajectory intent, identifying the trajectory conflicts, and presenting the alerts.

14. The system of claim 8, wherein the at least one processor is further configured to:

execute an airport moving map (AMM) application, wherein the processor is implemented as an aircraft onboard avionics device;

perform operations to identify the surface collision warning data, via the AMM application, wherein the operations comprise aggregating the 3D spatial data, determining the trajectory intent, identifying the trajectory conflicts, and presenting the alerts.

15. A non-transitory, computer-readable medium containing instructions thereon, which, when executed by a processor, perform a method for providing surface collision warning data onboard a first airport vehicle comprising an aircraft or other airport vehicle configured for ground-based travel, the method comprising:

aggregating, by the processor, three-dimensional (3D) spatial data associated with the first airport vehicle, an airport, and external airport vehicles located at the airport, to generate a set of aggregate data for the airport, wherein the 3D spatial data comprises at least vehicle 3D model specification data, surface movement radar (SMR) image and pattern processing data, camera thermal imaging data, and an airport mapping database, wherein the airport mapping database comprises a 3D spatial mapping of the airport including surface markings and airport structures comprising at least gates, terminals, aprons, hangars, and docking stations;

determining a trajectory intent for each of the external airport vehicles, wherein the external airport vehicles comprise at least a set of external aircraft, ground vehicles, stationary traffic, and moving traffic located at the airport;

identifying potential surface collisions between the first airport vehicle and the external airport vehicles and between the first airport vehicle and the airport structures, based on the set of aggregate data for the airport, the trajectory intent for each of the external airport vehicles, and a trajectory associated with the first airport vehicle; and presenting alerts associated with the potential surface collisions, via a display device communicatively coupled to the processor.

16. The non-transitory, computer-readable medium of claim 15, wherein the method further comprises:

establishing communication connections to one or more remote servers, via a communication device communicatively coupled to the processor;

obtaining the 3D spatial data associated with the first airport vehicle, the airport, and the external airport vehicles, via the communication connections; and loading the 3D spatial data into the system memory element onboard the first airport vehicle, wherein the method aggregates the 3D spatial data stored by the system memory element.

17. The non-transitory, computer-readable medium of claim 15, wherein the method further comprises:

establishing communication connections to one or more remote servers, via a communication device communicatively coupled to the processor; and accessing the 3D spatial data associated with the first airport vehicle, the airport, and the external airport vehicles, via the communication connections, wherein the method aggregates the 3D spatial data stored by the one or more remote servers.

18. The non-transitory, computer-readable medium of claim 15, wherein the alerts comprise at least one of a visual cue, an auditory alert, or a text-based message.

19. The non-transitory, computer-readable medium of claim 15, wherein the method further comprises:

executing an Electronic Flight Bag (EFB) application, by the processor, wherein the processor is implemented as a personal computing device; and performing operations to identify the surface collision warning data, via the EFB application, wherein the operations comprise aggregating the 3D spatial data, determining the trajectory intent, identifying the trajectory conflicts, and presenting the alerts.

20. The non-transitory, computer-readable medium of claim 15, wherein the method further comprises:

executing an airport moving map (AMM) application, by the processor, wherein the processor is implemented as an aircraft onboard avionics device; and performing operations to identify the surface collision warning data, via the AMM application, wherein the operations comprise aggregating the 3D spatial data, determining the trajectory intent, identifying the trajectory conflicts, and presenting the alerts.

* * * * *